US010058202B2

(12) United States Patent
Tran

(10) Patent No.: US 10,058,202 B2
(45) Date of Patent: Aug. 28, 2018

(54) SELF-ELEVATING CHOPSTICKS

(71) Applicant: Dang Minh Tran, San Diego, CA (US)

(72) Inventor: Dang Minh Tran, San Diego, CA (US)

( * ) Notice: Subject to any disclaimer, the term of this patent is extended or adjusted under 35 U.S.C. 154(b) by 0 days.

(21) Appl. No.: 15/145,338

(22) Filed: May 3, 2016

(65) Prior Publication Data

US 2017/0196387 A1 Jul. 13, 2017

Related U.S. Application Data

(63) Continuation-in-part of application No. 14/991,937, filed on Jan. 9, 2016.

(51) Int. Cl.
*A47G 21/06* (2006.01)

(52) U.S. Cl.
CPC ..... *A47G 21/103* (2013.01); *A47G 2400/025* (2013.01)

(58) Field of Classification Search
CPC ..... A47G 21/103
USPC ..... 294/99.1, 99.2, 218
See application file for complete search history.

(56) References Cited

U.S. PATENT DOCUMENTS 2,789,349 A * 4/1957 Lee Paula ..... B26B 3/02 30/295
D345,486 S * 3/1994 Burdick ..... D7/401.2
D346,722 S * 5/1994 Burdick ..... D7/642
5,431,465 A * 7/1995 Shibata ..... A47G 21/103 294/218
6,328,360 B1 * 12/2001 Freeman ..... A47G 21/103 206/553
7,093,868 B1 * 8/2006 Shen ..... A47G 21/103 294/218
D592,019 S * 5/2009 Holcomb ..... D7/643
7,571,943 B1 * 8/2009 Lee ..... A47G 21/103 294/218
8,292,343 B2 10/2012 Hsu
8,870,254 B2 10/2014 Marshall, III
9,259,111 B1 * 2/2016 Joyner ..... A47G 21/103
2007/0084063 A1 4/2007 Hughes
2007/0220750 A1 * 9/2007 Chen ..... A47G 21/103 30/1
2009/0026782 A1 * 1/2009 Lion ..... A47G 21/181 294/99.2
2009/0051179 A1 * 2/2009 Wang ..... A47G 21/103 294/218
2009/0108600 A1 * 4/2009 Ichinose ..... A47G 21/103 294/218
2009/0121501 A1 * 5/2009 Liu ..... A47G 21/10 294/218
2009/0126204 A1 * 5/2009 Wagner ..... A47G 19/00 30/345
2009/0226239 A1 * 9/2009 Lin ..... A45D 40/18 401/195
2009/0302043 A1 * 12/2009 Yang ..... A47G 19/00 220/574

(Continued)

FOREIGN PATENT DOCUMENTS

JP 407194473 A * 8/1995

*Primary Examiner* — Paul T Chin
(74) *Attorney, Agent, or Firm* — Merle W. Richman, III

(57) ABSTRACT

An eating utensil including a chopsticks 1, 1A-1H that includes a self-elevating eating section 10, 10A-H feature regardless of placement of a handling section 12, 12A-12H on a horizontal surface 32 (when a chopstick is rested by a User). Other embodiments may be described and claimed.

18 Claims, 20 Drawing Sheets

(56) References Cited

U.S. PATENT DOCUMENTS

| | | | | |
|---|---|---|---|---|
| 2011/0042977 | A1* | 2/2011 | Shen | A47G 21/103 294/218 |
| 2012/0068487 | A1* | 3/2012 | Wong | A47G 21/103 294/218 |
| 2013/0133206 | A1 | 5/2013 | Donovan | |

* cited by examiner

30

SELF-ELEVATING CHOPSTICKS

CROSS REFERENCE TO RELATED APPLICATIONS

The present application is a continuation-in-part of the application entitled "Gravity Chopstick", assigned application Ser. No. 14/991,837, filed Jan. 9, 2016, which is incorporated by reference.

TECHNICAL FIELD

Various embodiments described herein relate eating utensils.

BACKGROUND INFORMATION

A pair of chopsticks are commonly used as eating utensils. Each chopstick commonly has two sections, one section for picking up food that can be referred to as an eating section and the other end for holding by a user that can be referred to as a handling section. In use the section for picking up food, also the chopstick eating section, may become covered with bits of food or sauce. When not in use, chopsticks may be placed flat on a horizontal surface, such as a tabletop commonly causing an area of the chopstick eating section to contact the horizontal surface. To avoid contaminating a chopstick eating section or a selected horizontal resting surface area (i.e. table), a user may rest or lean the chopsticks on a chopstick rest or other item to prevent undesired eating section contamination. It may be inconvenient and wasteful to employ a separate object to rest a chopstick. The present invention eliminates the need for a separate rest object.

DETAILED DESCRIPTION

Figure 1:
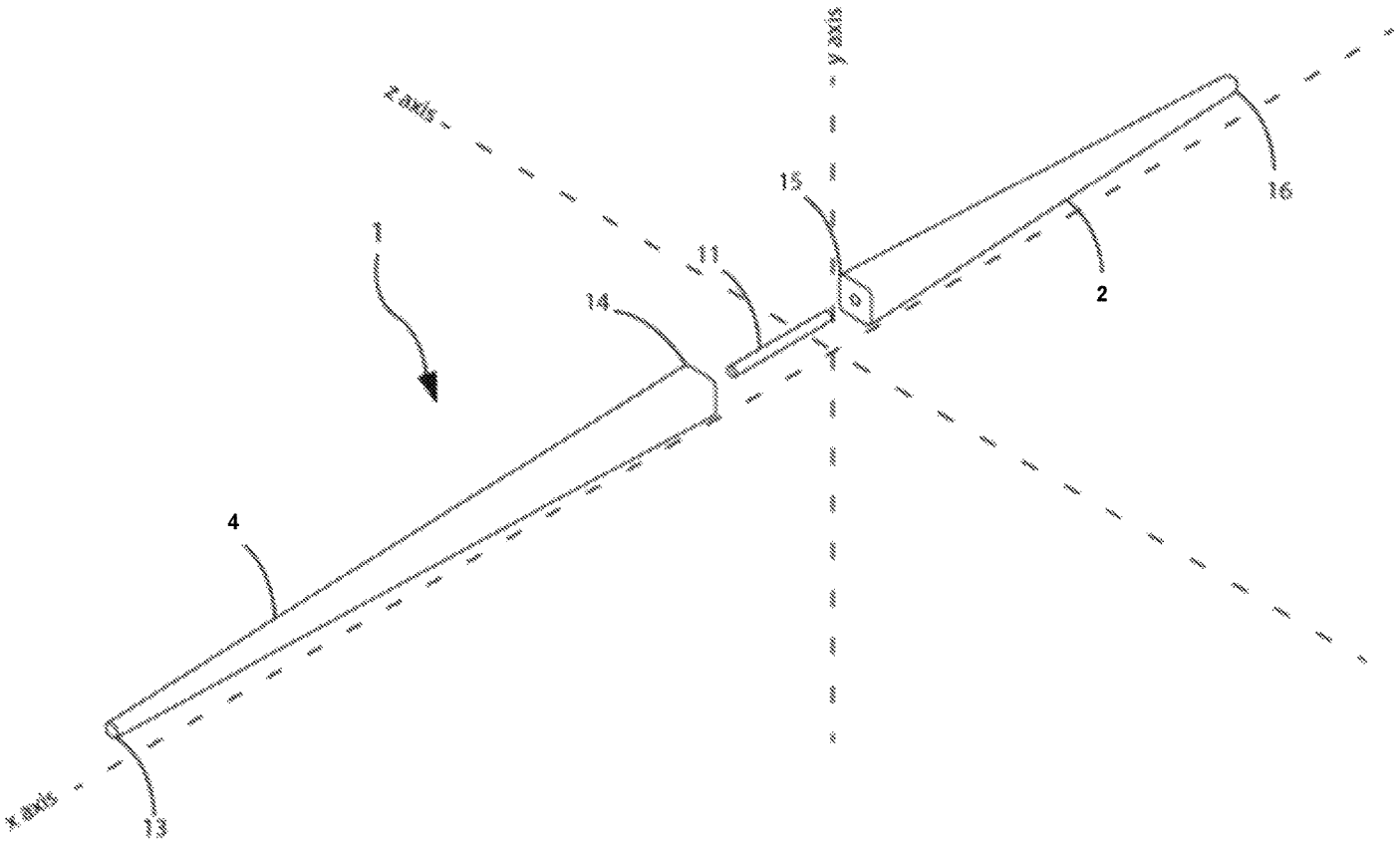
FIG. 1 is a simplified isometric diagram of a first embodiment of a chopstick in an exploded view positioned along a three-dimensional Cartesian coordinate system according to various embodiments.

The embodiments of chopsticks 1, 1A-1H of the present invention eliminates the previously described problems by providing an eating section self-elevating feature regardless of side placement of a handling section on a horizontal surface 32 (when a chopstick is rested by a User). In an embodiment, a chopstick 1, 1A-H may have an elongated or longitudinal axis 18, 18A-H including a pivot point 17, 17A-H, an eating section 10, 10A-H on a left side of the pivot point 17, 17A-H, and a handling section 12, 12A-H on the right side of the pivot point 17, 17A-H.

In an embodiment, the pivot point 17, 17A-H may be partially in eating section 10, 10A-H or the handling section 12, 12A-H. Further in an embodiment, the mass of the handling section 12, 12A-H right of the pivot point 17, 17A-H may be greater than the mass of the eating section 10, 10A-H left of the pivot point 17, 17A-H at all times (mass is fixed in both sections 12, 12A-H, 10, 10A-H). In such an embodiment, the eating section 10, 10A-H may remain and become instantly (subject to force of gravity acting on chopstick 1, 1A-H) elevated about a horizontal resting surface 32 when placed on the horizontal surface 32.

In particular due to the mass differential between a handling section 12, 12A-H and eating section 10, 10A-H, an area (or all) of a handling section 12, 12A-H of a chopstick 1, 1A-H in addition to the pivot point 17, 17A-H may contact a horizontal surface 32 when placed thereon by a User. A desired area (generally near the distal end 13, 13A-H) or all of the eating section 10, 10A-H may not contact the horizontal surface 32 when placed thereon, preventing or limiting contamination of the desired area (distal section of eating section) or all of the eating section 10, 10A-H and the horizontal surface 32. The elevation of eating section 10, 10A-H may reduce the risk of bacteria or dirt from contacting the eating section 10, 10A-H, in particular the distal end 13, 13A-13H, which may come in contact with the user's mouth when in use.

In an embodiment, a chopstick's 1, 1A-H eating section 10, 10A-H length along the longitudinal axis 18 may be longer than the handling section 12, 12A-H length. In another embodiment, a chopstick's 1, the handling section 12, 12A-H length along the axis 18 may be longer than or equal to the eating section 10, 10A-H length. In an embodiment, a chopstick's 1, 1A-H eating section 10, 10A-H length along the axis 18 may be slightly greater than the handling section 12, 12A-H length. In other embodiments the handling section 12, 12A-H length relative to the 1A-H eating section 10, 10A-H length along the axis 18 may vary in order to be more ergonomically accommodating to different users.

As shown in FIGS. 1, 1A-H and described below in an embodiment, the eating section 10, 10A-H may be formed from a less dense (lower mass/area) material (the component 4 in FIG. 1) than the handling section 12, 12A-H material (the component 2). In addition, the eating section 10, 10A-H and the handling section 12, 12A-H may be formed from the same material but the eating section 10, 10A-H may be still have less mass than handling section 12, 12A-H due to physical differences between the sections. The eating section 10, 10A-H may include hollow regions (20A, FIG. 5C), fins (24F, FIG. 10A) or a reduced relative diameter (FIG. 6A) in an embodiment.

In the description of embodiments of the invention disclosed herein, any reference to direction or orientation is intended for convenience of description and is not intend in any way to limit the scope of the present invention. Terms such as "attached", "connected" refer to a relationship wherein parts are secured or attached to one another either directly or indirectly through intervening parts wherein the parts may be removably or permanently coupled together in an embodiment.

Features and benefits of the invention are not be limited to the exemplary embodiments nor the scope of the invention being defined by the claims stated herein. In an embodiment, a chopstick 1 (FIGS. 1-4) and 1H (FIGS. 12A-D) may include multiple components 2, 4 that are coupled to form the chopstick 1, 1H. Another chopstick 1A-1G (FIGS. 5A-11C) may include a single component 3A-G. It is noted that chopsticks 1A-1G may also be formed from multiple components while still providing the desired eating section elevation or contamination protection.

Figure 2:
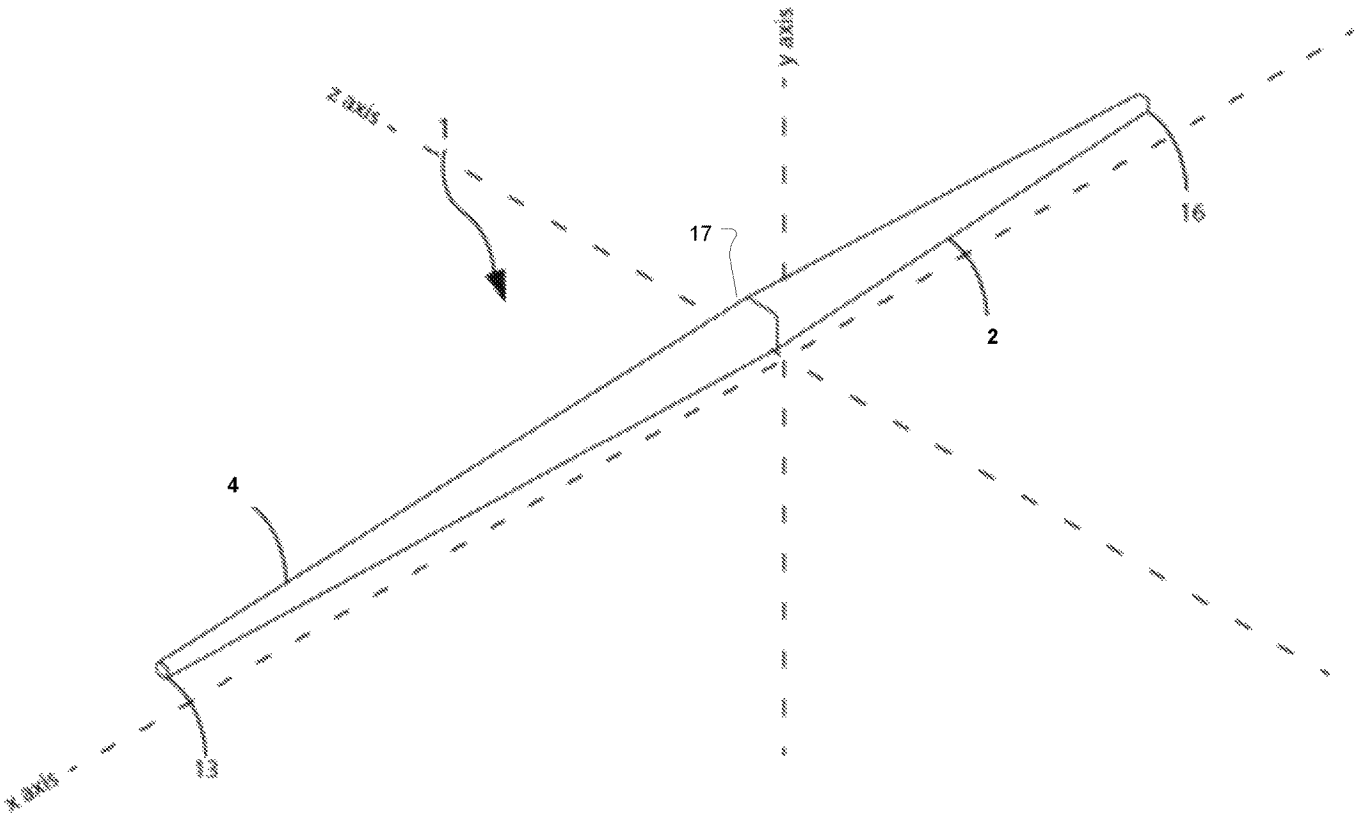
FIG. 2 is a simplified isometric diagram of the first embodiment of a chopstick positioned along a three-dimensional Cartesian coordinate system according to various embodiments.
Figure 3:
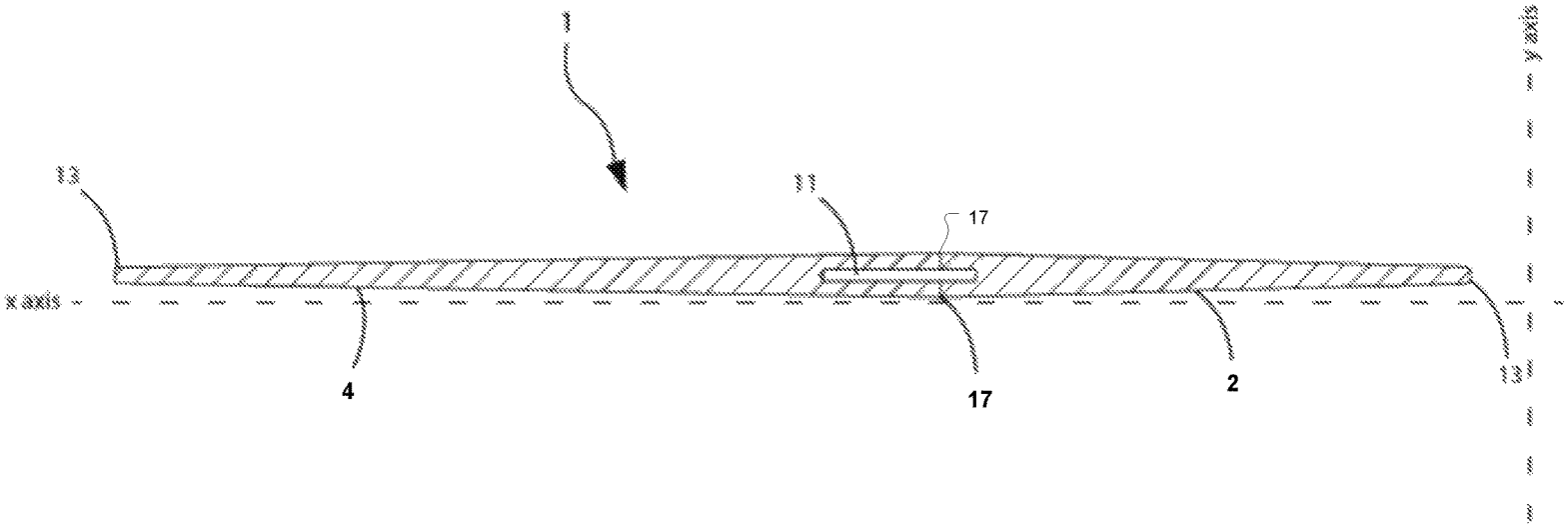
FIG. 3 is a cross sectional diagram along the left side of the first embodiment of a chopstick according to various embodiments.
Figure 4:
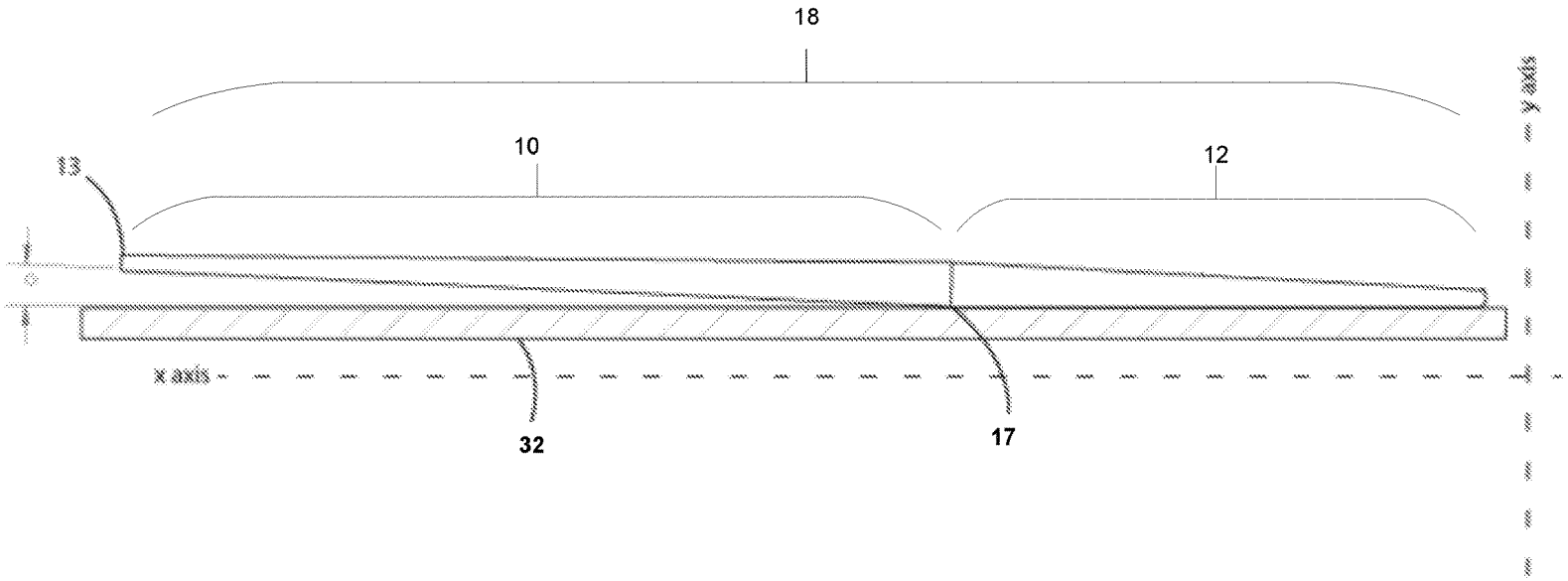
FIG. 4 is a left side diagram of the first embodiment of a chopstick resting on a horizontal surface according to various embodiments.

FIG. 1 is a simplified isometric diagram of a first embodiment of a multi-component chopstick 1 in an exploded view positioned along a three-dimensional Cartesian coordinate system according to various embodiments. FIG. 2 is a simplified isometric diagram of the first embodiment of a multi-component chopstick 1 as assembled according to various embodiments. FIG. 3 is a cross sectional diagram along the left side of the first embodiment of a multi-component chopstick 1 according to various embodiments and FIG. 4 is a left side diagram of a system 30 including the first embodiment of a multi-component chopstick 1 resting on a horizontal surface 32 according to various embodiments. As shown in FIGS. 1-4, the chopstick 1 may include a first component 2 and a second component 4 that may be coupled together via a coupling mechanism 11.

In an embodiment, the first component 2 and second component 4 when coupled as shown FIGS. 2-4, may extend along an elongated or longitudinal axis 18 of the chopstick. The chopstick's 1 elongated or longitudinal axis 18 may include an eating section 10 and a handling section 12 in an embodiment with a pivot point 17 formed there between due to the shape of chopstick's 1 eating section 10 and handling section 12. Further in an embodiment, the mass of the handling section 12 right of the pivot point 17 may be greater than the mass of the eating section 10 left of the pivot point 17 at all times (mass is fixed in both sections 10, 12). In such an embodiment, the eating section 10 may remain and become instantly (subject to force of gravity acting on chopstick 1) elevated about a horizontal resting surface 32 when placed on the horizontal surface 32 as shown in FIG. 4.

As shown in FIGS. 1-4, the chopstick's 1 first component 2 may form the handling section 12 of the axis 18 and the second component 4 may form the eating section 10 of the axis 18. The first component's 2 handling section 12 may include a proximal end 15 near the pivot point 17 and a distal end 16. Similarly, the second component's 4 eating section 10 may include a proximal end 14 near the pivot point 17 and a distal end 13 where the distal end 13 may be more likely employed by User to grip food or other elements. As shown in FIGS. 1-4, the first component's 2 handling section 12 may be tapered from the proximal end 15 near the pivot point 17 to the distal end 16.

Similarly, the second component's 4 eating section 10 may be tapered from the proximal end 14 near the pivot point 17 to the distal end 13. The respective tapering of the first component's 2 handling section 12 and the second component's 4 eating section 10 may form the pivot point 17 in an embodiment. In an embodiment the elongated tapered sides of the first component's 2 handling section 12 may be mirror images of each other and all elongated tapered sides of the second component's 4 eating section 10 may be mirror images of each other. In addition, the first component's 2 handling section 12 or of the second component's 4 eating section 10 may include undulations or inward indentations.

In an embodiment, the second component's 4 eating section 10 may be formed substantially of first material and the first component's 2 handling section 12 may be formed substantially of a second, different material. The second material may have a greater density than the first material.

In another embodiment, the second component's 4 eating section 10 and the first component's 2 handling section 12 may be formed substantially of same material or element. In an embodiment, the first and second materials may include natural and man-made elements including but not limited to metals, alloys, minerals, petroleum based materials (polymers and others), and plant based materials (wood and others).

In an embodiment, the first component's 2 handling section 12 and the second component's 4 eating section 10 may have various cross sectional shapes relative to the longitudinal axis 18 including round, elliptical, square, rectangular, or other polygon. In an embodiment, the chopstick 1 components 2, 4 (eating section/handling section) may each have four sides along the longitudinal axis 18 of the chopstick 1. In an embodiment, the first component's 2 handling section 12 may be securely coupled to the second component's 4 eating section 10 via a coupling mechanism. The coupling mechanism 11 may include a pin and the proximal ends of the first component's 2 handling section 12 and the second component's 4 eating section 10 may have holes or fenestrations sized to receive and hold the pin 11 in a secure and fixed position.

In another embodiment, the first component's 2 handling section 12 may be securely but removably coupled to the second component's 4 eating section 10 via a coupling mechanism 11. The coupling mechanism 11 may include a threaded component and one or both of the first component's 2 handling section 12 and the second component's 4 eating section 10 may include a receiving, mating thread. Such a configuration may enable the first component's 2 handling section 12 to be securely and removably coupled to the second component's 4 eating section 10. In such an embodiment, a User may be able to remove the second component's 4 eating section 10 from the chopstick 1 and replace it with another the second component's 4 eating section 10 while reusing the first component's 2 handling section 12.

Figure 5A:
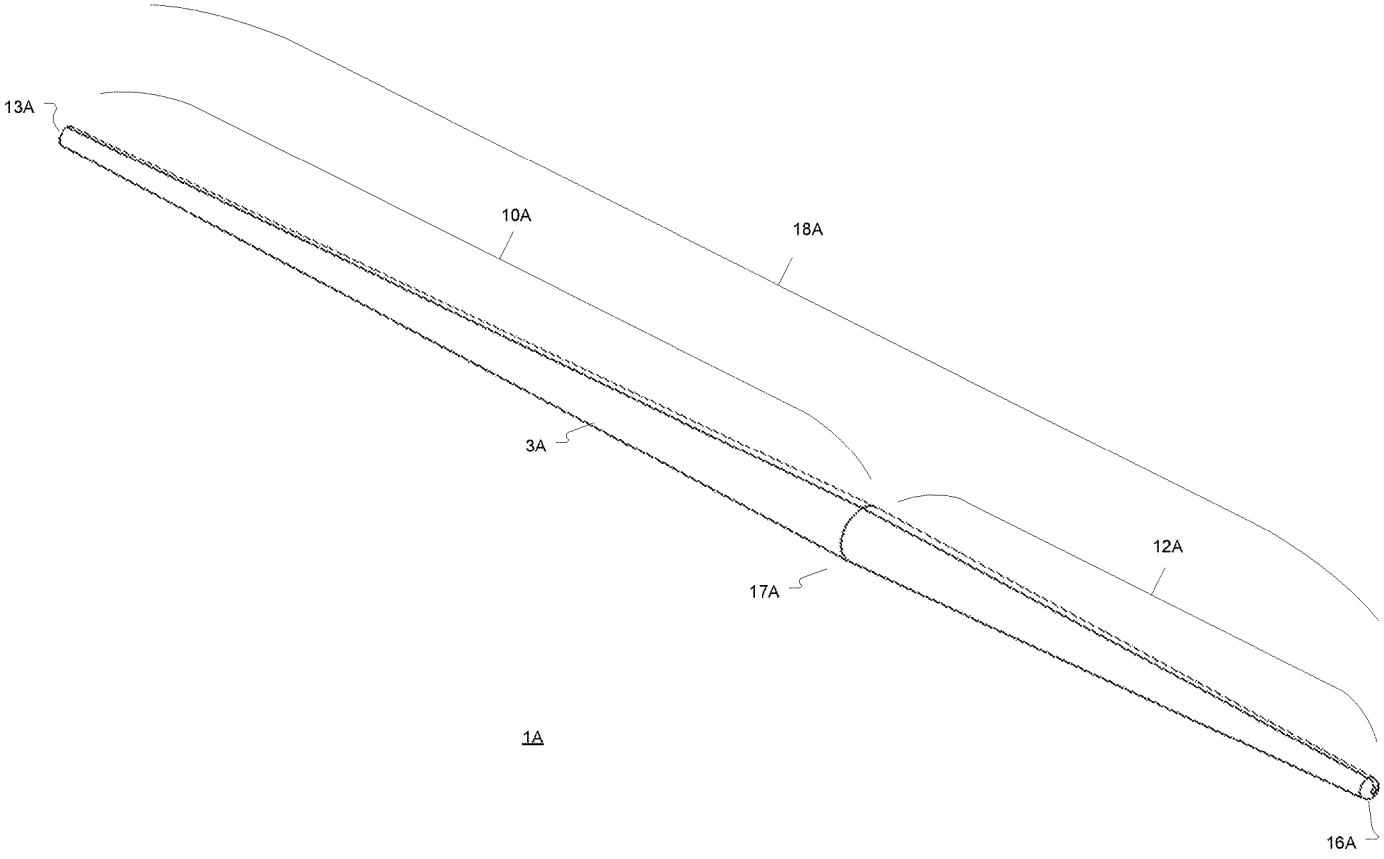
FIG. 5A is a simplified isometric diagram of a second embodiment of a chopstick according to various embodiments.
Figure 5B:
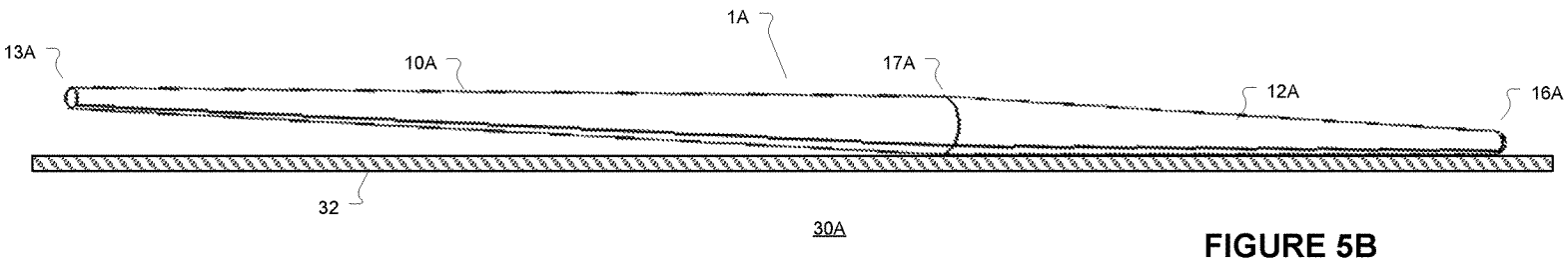
FIG. 5B is a left side, isometric diagram of the second embodiment of a chopstick resting on a horizontal surface according to various embodiments.
Figure 5C:
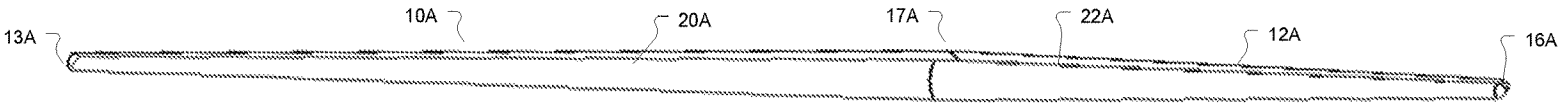
FIG. 5C is a cross sectional diagram along the left side of the second embodiment of a chopstick according to various embodiments.

FIG. 5A is a simplified isometric diagram of a second embodiment of a chopstick 1A according to various embodiments. FIG. 5B is a left side, isometric diagram of a system 30A including the second embodiment of a chopstick 1A resting on a horizontal surface 32 according to various embodiments. FIG. 5C is a cross sectional diagram along the left side of the second embodiment of a chopstick 1A according to various embodiments. As shown in FIGS. 5A-C, the chopstick 1A may include a single component 3A.

In an embodiment, the single component may extend along an elongated or longitudinal axis 18A of the chopstick 1A. The chopstick's 1A elongated or longitudinal axis 18A may include an eating section 10A and a handling section 12A in an embodiment with a pivot point 17A formed there between due to the shape of chopstick's 1A eating section 10A and handling section 12A. Further in an embodiment, the mass of the handling section 12A right of the pivot point 17A may be greater than the mass of the eating section 10A left of the pivot point 17A at all times (mass is fixed in both sections 10A, 12A of the component 3A). In such an embodiment, the eating section 10A may remain and become instantly (subject to force of gravity acting on chopstick 1A) elevated about a horizontal resting surface 32 when placed on the horizontal surface 32 as shown in FIG. 5B.

The handling section 12A may include a proximal end near the pivot point 17A and a distal end 16A. Similarly, the eating section 10A may include a proximal end near the pivot point 17A and a distal end 13A where the distal end 13A may be more likely employed by User to grip food or other elements. As shown in FIGS. 5A-5C, the handling section 12A may be tapered from the proximal end near the pivot point 17A to its distal end 16A.

Similarly, the eating section 10A may be tapered from its proximal end near the pivot point 17A to its distal end 13A. The respective tapering of the handling section 12A and the eating section 10A may form the pivot point 17A in an embodiment. As noted, the eating section 10A and the handling section 12A may be sections of a single component 3A. The single component 3A may be comprised of one material or element in an embodiment. The single material may include natural and man-made elements including but not limited to metals, alloys, minerals, petroleum based materials (polymers and others), and plant based materials (wood and others). In an embodiment, the chopstick 1A components may be formed via an extrusion process where the single material is man-made.

In an embodiment, the handling section 12A and the eating section 10A may have various cross sectional shapes relative to the longitudinal axis 18A including round, elliptical, square, rectangular, or other polygon. In an embodiment, a region of the eating section 10A of the component 3A may be hollow 20A as shown in FIG. 5C. The handing section 12A may not be hollow 22A or include a smaller hollow region. The component 3A eating section 10A hollow region 20A may enable the eating section 10A mass to be less than the handling section 12A mass, enabling at least a distal region 13A of the component 3A eating section 10A to be elevated above a horizontal surface 32 when placed thereon.

Figure 6A:
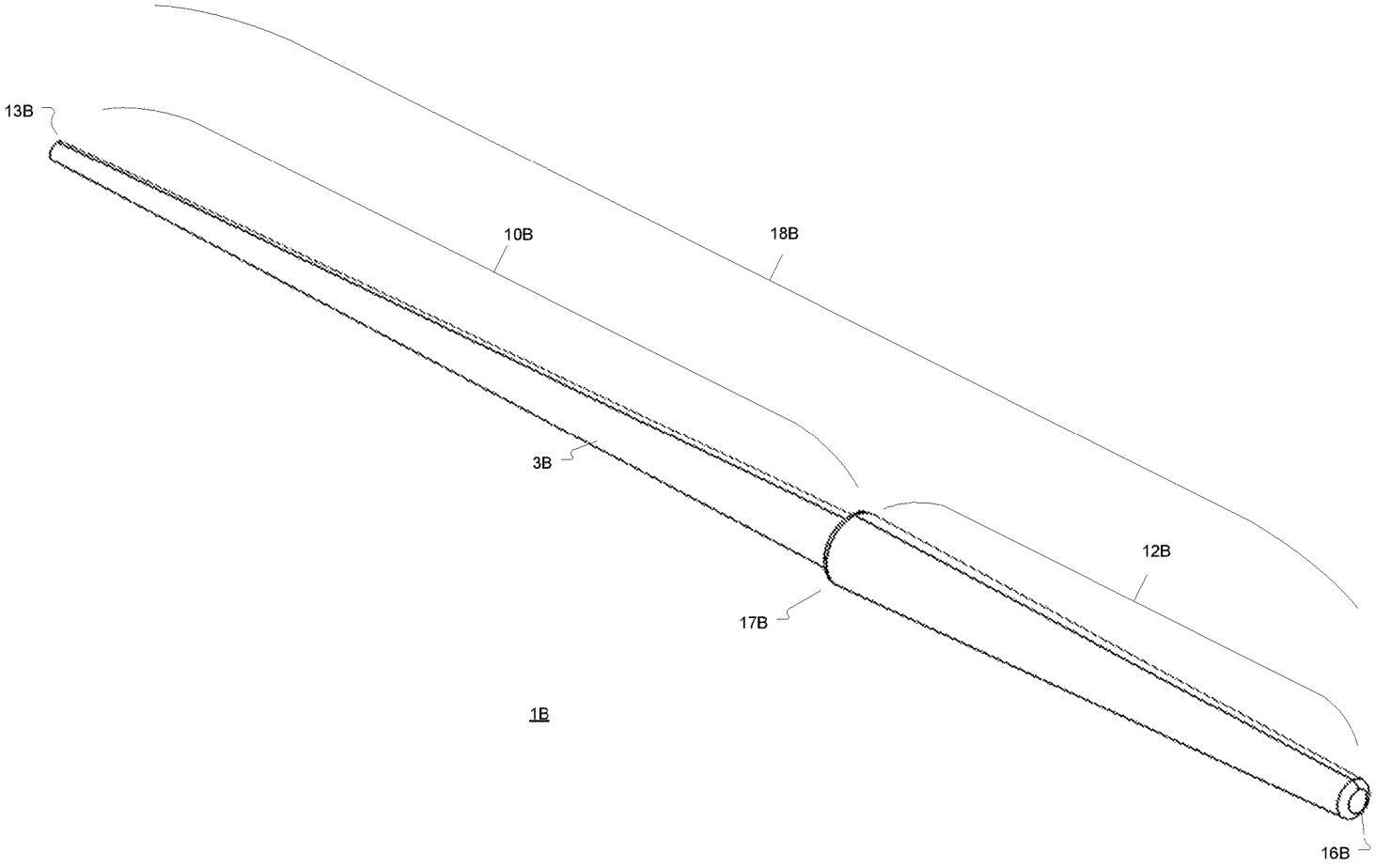
FIG. 6A is a simplified isometric diagram of a third embodiment of a chopstick according to various embodiments.
Figure 6B:
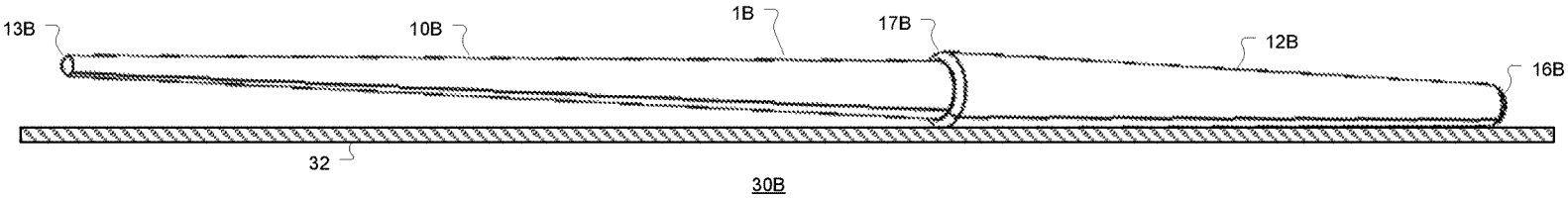
FIG. 6B is a left side, isometric diagram of the third embodiment of a chopstick resting on a horizontal surface according to various embodiments.
Figure 6C:
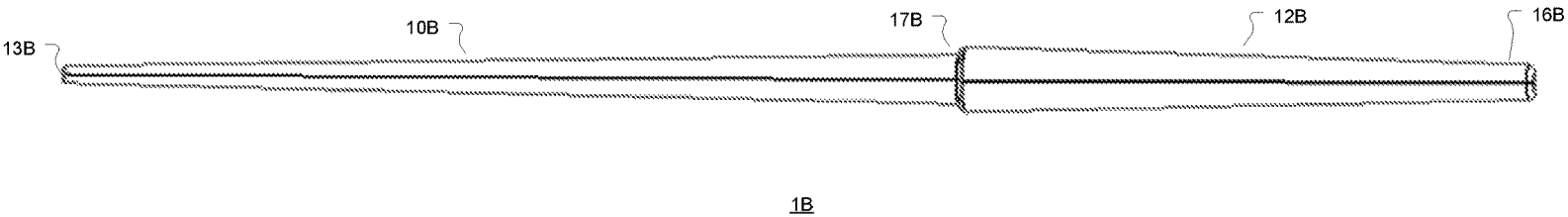
FIG. 6C is a left side diagram of the third embodiment of a chopstick according to various embodiments.

FIG. 6A is a simplified isometric diagram of a third embodiment of a chopstick 1B according to various embodiments. FIG. 6B is a left side, isometric diagram of a system 30B including the third embodiment of a chopstick 1B resting on a horizontal surface 32 according to various embodiments. FIG. 6C is a left side diagram of the third embodiment of a chopstick 1B according to various embodiments. As shown in FIGS. 6A-C, the chopstick 1B may include a single component 3B.

In an embodiment, the single component 3B may extend along an elongated or longitudinal axis 18B of the chopstick 1B. The chopstick's 1B elongated or longitudinal axis 18B may include an eating section 10B and a handling section 12B in an embodiment with a pivot point 17B formed on a proximal end of the handling section due to the shape of chopstick's 1B eating section 10B and handling section 12B. Further in an embodiment, the mass of the handling section 12B right of the pivot point 17B may be greater than the mass of the eating section 10B left of the pivot point 17B at all times (mass is fixed in both sections 10B, 12B of the component 3B). The mass differential may be due to the increased cross sectional diameter of the handling section 12B relative to the cross-sectional diameter of the eating section 10B as shown in FIGS. 6A-C. In such an embodiment, the eating section 10B may become instantly (subject to force of gravity acting on chopstick 1B) and remain elevated on a horizontal surface 32 when placed on the horizontal surface 32 as shown in FIG. 6B.

The handling section 12B may include a proximal end near the pivot point 17B and a distal end 16B. Similarly, the eating section 10B may include a proximal end near the pivot point 17B and a distal end 13B where the distal end 13B may be more likely employed by User to grip food or other elements. As shown in FIGS. 6A-C, the handling section 12B may be tapered from the proximal end near the pivot point 17B to its distal end 16B.

Similarly, the eating section 10B may be tapered from its proximal end near the pivot point 17B to its distal end 13B. The handling section's 12B larger cross sectional diameter relative to the eating section's 10B cross sectional diameter may form the pivot point 17B in an embodiment. As noted, the eating section 10B and the handling section 12B may be sections of a single component 3B. The single component 3B may be comprised of one material or element in an embodiment. The single material may include natural and man-made elements including but not limited to metals, alloys, minerals, petroleum based materials (polymers and others), and plant based materials (wood and others). In an embodiment, the chopstick 1B components may be formed via an extrusion process where the single material is man-made.

In an embodiment, the handling section 12B and the eating section 10B may have various cross sectional shapes relative to the longitudinal axis 18B including round, elliptical, square, rectangular, or other polygon. In an embodiment, a region of the eating section 10B of the component 3B may be hollow 20B. The handing section 12B may not be hollow or include a smaller hollow region. As noted, the component's 3B eating section 10B smaller cross sectional diameter may enable the eating section's 10B mass to be less than the handling section's 12B mass, enabling at least a distal region 13B of the component's 3B eating section 10B to be elevated above a horizontal surface 32 when placed thereon.

Figure 7A:
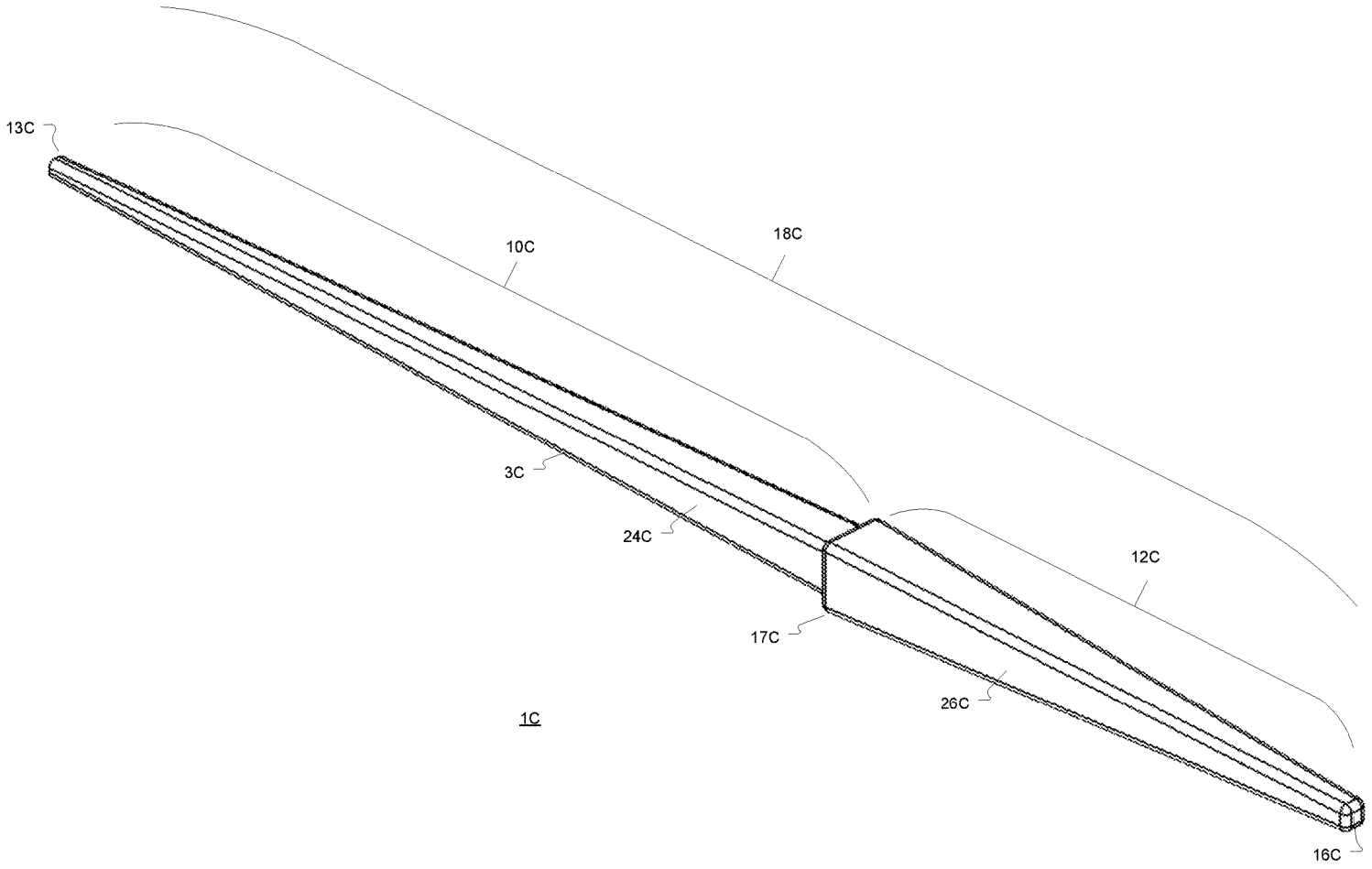
FIG. 7A is a simplified isometric diagram of a fourth embodiment of a chopstick according to various embodiments.
Figure 7B:
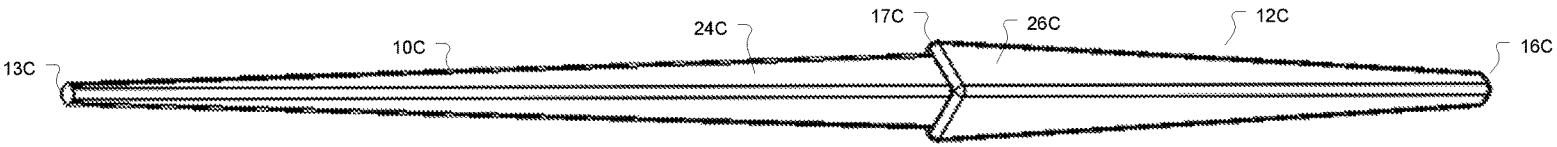
FIG. 7B is a left side, isometric diagram of the fourth embodiment of a chopstick according to various embodiments.
Figure 7C:
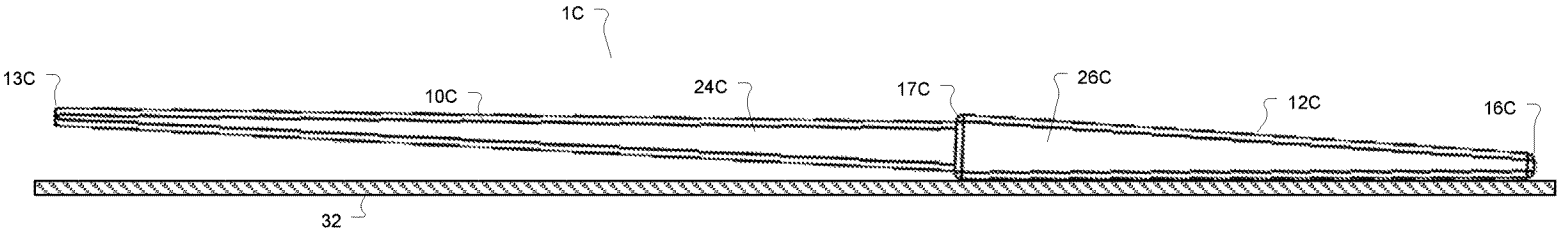
FIG. 7C is a left side diagram of the fourth embodiment of a chopstick resting on a horizontal surface according to various embodiments.

FIG. 7A is a simplified isometric diagram of a fourth embodiment of a chopstick 1C according to various embodiments. FIG. 7B is a left side, isometric diagram of the fourth embodiment of a chopstick 1C according to various embodiments. FIG. 7C is a left side diagram of a system 30C including a fourth embodiment of a chopstick 1C resting on a horizontal surface 32 according to various embodiments. As shown in FIGS. 7A-C, the chopstick 1C may include a single component 3C.

In an embodiment, the single component 3C may extend along an elongated or longitudinal axis 18C of the chopstick 1C. The chopstick's 1C elongated or longitudinal axis 18C may include an eating section 10C and a handling section 12C in an embodiment with a pivot point 17C formed on a proximal end of the handling section 12C due to the shape of chopstick's 1C eating section 10C and handling section 12C. Further in an embodiment, the mass of the handling section 12C right of the pivot point 17C may be greater than the mass of the eating section 10C left of the pivot point 17C at all times (mass is fixed in both sections 10C, 12C of the component 3C). The mass differential may be due to the increased effective cross sectional diameter of the handling section 12C relative to the effective cross-sectional diameter of the eating section 10C as shown in FIGS. 7A-C. In such an embodiment, the eating section 10C may become instantly (subject to force of gravity acting on chopstick 1C) and remain elevated on a horizontal surface 32 when placed on the horizontal surface 32 as shown in FIG. 7C.

The handling section 12C may include a proximal end near the pivot point 17C and a distal end 16C. Similarly, the eating section 10C may include a proximal end near the pivot point 17C and a distal end 13C where the distal end 13C may be more likely employed by User to grip food or other elements. As shown in FIGS. 7A-C, the handling section 12C may be tapered from the proximal end near the pivot point 17C to its distal end 16C and form a number of sides 26C, four sides in an embodiment.

Similarly, the eating section 10C may be tapered from its proximal end near the pivot point 17C to its distal end 13C and form a number of sides 24C, four sides in an embodiment. The handling section's 12C larger effective cross sectional diameter relative to the eating section's 10C effective cross sectional diameter may form the pivot point 17C in an embodiment. As noted, the eating section 10C and the handling section 12C may be sections of a single component 3C. The single component 3C may be comprised of one material or element in an embodiment. The single material may include natural and man-made elements including but not limited to metals, alloys, minerals, petroleum based materials (polymers and others), and plant based materials (wood and others). In an embodiment, the chopstick 1C components may be formed via an extrusion process where the single material is man-made.

In an embodiment, the handling section 12C and the eating section 10C may have various cross sectional shapes relative to the longitudinal axis 18C including round, elliptical, square, rectangular, or other polygon. In an embodiment, a region of the eating section 10C of the component 3C may be hollow. The handing section 12C may not be hollow or include a smaller hollow region. As noted, the component's 3C eating section 10C smaller effective cross sectional diameter may cause the eating section's 10C mass to be less than the handling section 12C mass, enabling the at least a distal region 13C of component's 3C eating section 10C to be elevated above a horizontal surface 32 when placed thereon.

Figure 8A:
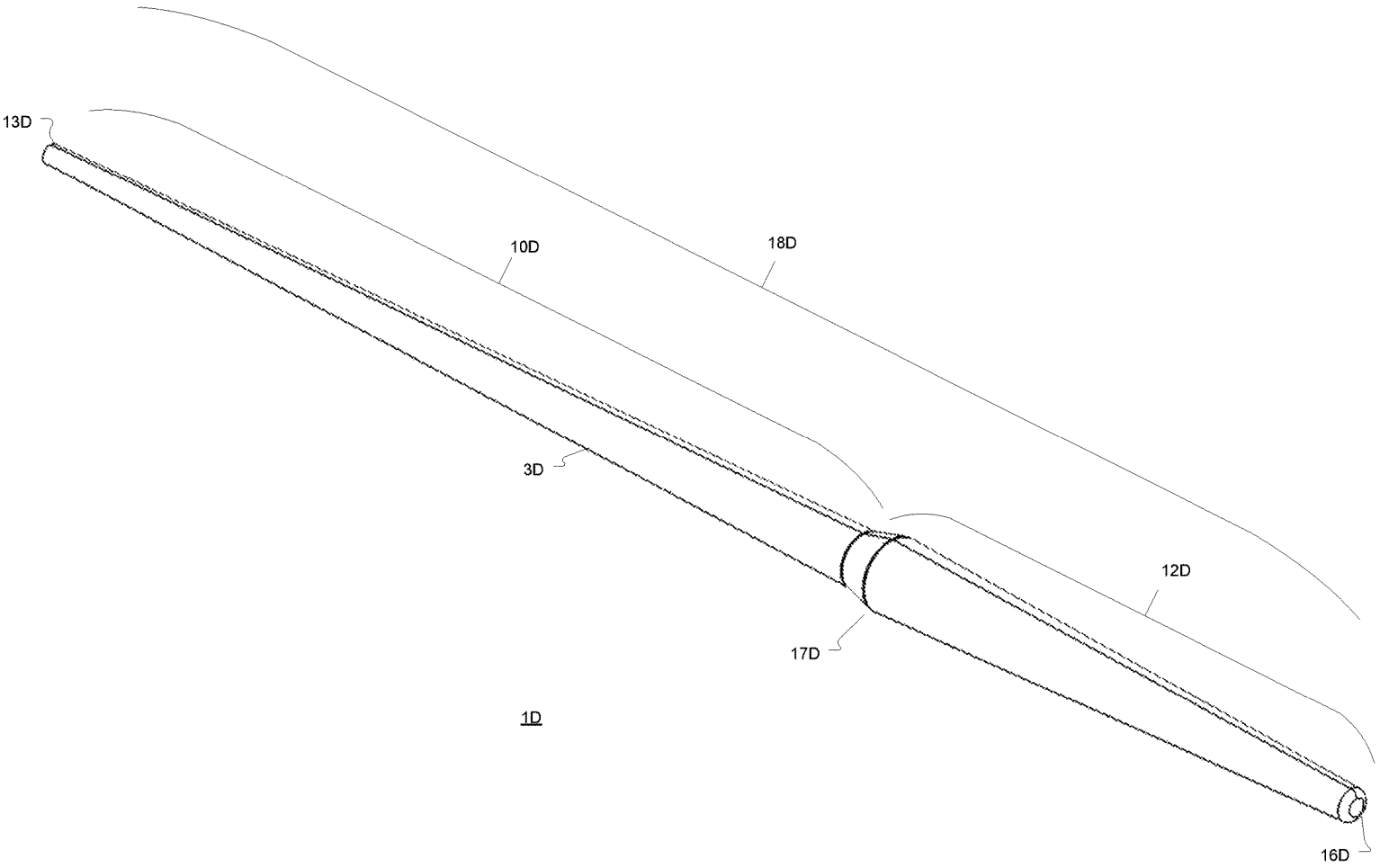
FIG. 8A is a simplified isometric diagram of a fifth embodiment of a chopstick according to various embodiments.
Figure 8B:
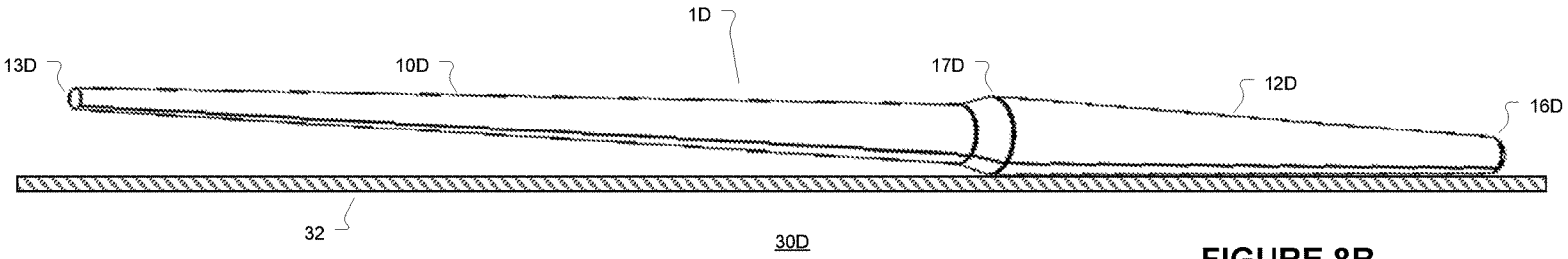
FIG. 8B is a left side, isometric diagram of the fifth embodiment of a chopstick resting on a horizontal surface according to various embodiments.
Figure 8C:
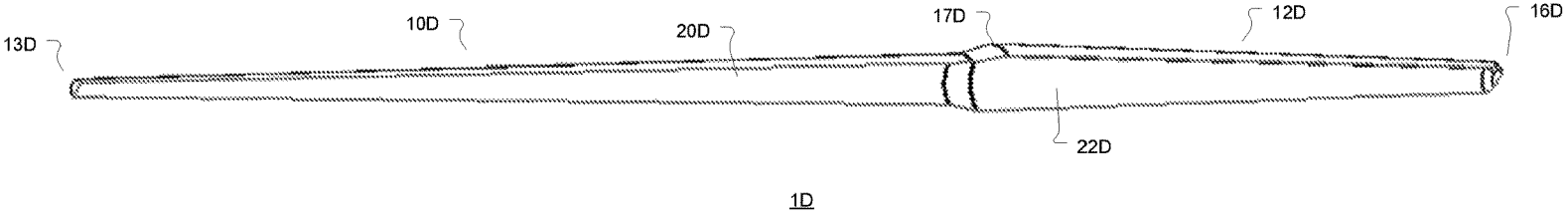
FIG. 8C is a cross sectional diagram along the left side of the fifth embodiment of a chopstick according to various embodiments.

FIG. 8A is a simplified isometric diagram of a fifth embodiment of a chopstick 1D according to various embodiments. FIG. 8B is a left side, isometric diagram of a system 30D including the fifth embodiment of a chopstick 1D resting on a horizontal surface 32 according to various embodiments. FIG. 8C is a cross sectional diagram along the left side of the fifth embodiment of a chopstick 1D according to various embodiments. As shown in FIGS. 8A-C, the chopstick 1D may include a single component 3D in an embodiment.

In an embodiment, the single component 3D may extend along an elongated or longitudinal axis 18D of the chopstick 1D. The chopstick's 1D elongated or longitudinal axis 18D may include an eating section 10D and a handling section 12D in an embodiment with a pivot point 17D formed in a proximal section of the handling section 12D due to the shape of chopstick's 1D eating section 10D and handling section 12D. Further in an embodiment, the mass of the handling section 12D right of the pivot point 17D may be greater than the mass of the eating section 10D left of the pivot point 17D at all times (mass is fixed in both sections 10D, 12D of the component 3D). The mass differential may be due to the increased effective cross sectional diameter of the handling section 12D relative to the effective cross-sectional diameter of the eating section 10D as shown in FIGS. 8A-C. In such an embodiment, the eating section 10D may become instantly (subject to force of gravity acting on chopstick 1D) and remain elevated on a horizontal surface 32 when placed or rested on the horizontal surface 32 as shown in FIG. 8B.

The handling section 12D may include a proximal section forming the pivot point 17D and a distal end 16D. Similarly, the eating section 10D may include a proximal end near the pivot point 17D and a distal end 13D where the distal end 13D may be more likely employed by User to grip food or other elements. As shown in FIGS. 8A-C, the handling section 12D may be first tapered from the proximal section pivot point 17D to its distal end 16C and second tapered from the pivot point 17D to its intersection with the eating section 10D proximal end in an embodiment. Such a configuration may make the handling section 12D more comfortable to be held by a User.

Similarly, the eating section 10D may be tapered from its proximal end near the handling section's 12D second taper to its distal end 13D. The handling section's 12D larger effective cross sectional diameter relative to the eating section's 10D effective cross sectional diameter and the handling section's 12D second taper may form the pivot point 17D in an embodiment. As noted, the eating section 10D and the handling section 12D may be sections of a single component 3D. The single component 3D may be comprised of one material or element in an embodiment. The single material may include natural and man-made elements including but not limited to metals, alloys, minerals, petroleum based materials (polymers and others), and plant based materials (wood and others). In an embodiment, the chopstick 1D components may be formed via an extrusion process where the single material is man-made.

In an embodiment, the handling section 12D and the eating section 10D may have various cross sectional shapes relative to the longitudinal axis 18D including round, elliptical, square, rectangular, or other polygon. In an embodiment, a region of the eating section 10D of the component 3D may be hollow 20D. The handing section 12D may not be hollow or include a smaller hollow region 22D. As noted, the component's 3D eating section 10D smaller effective cross sectional diameter may cause the eating section's 10D mass to be less than the handling section 12D mass, enabling at least a distal region 13D of the component's 3D eating section 10D to be elevated above a horizontal surface 32 when placed thereon.

Figure 9A:
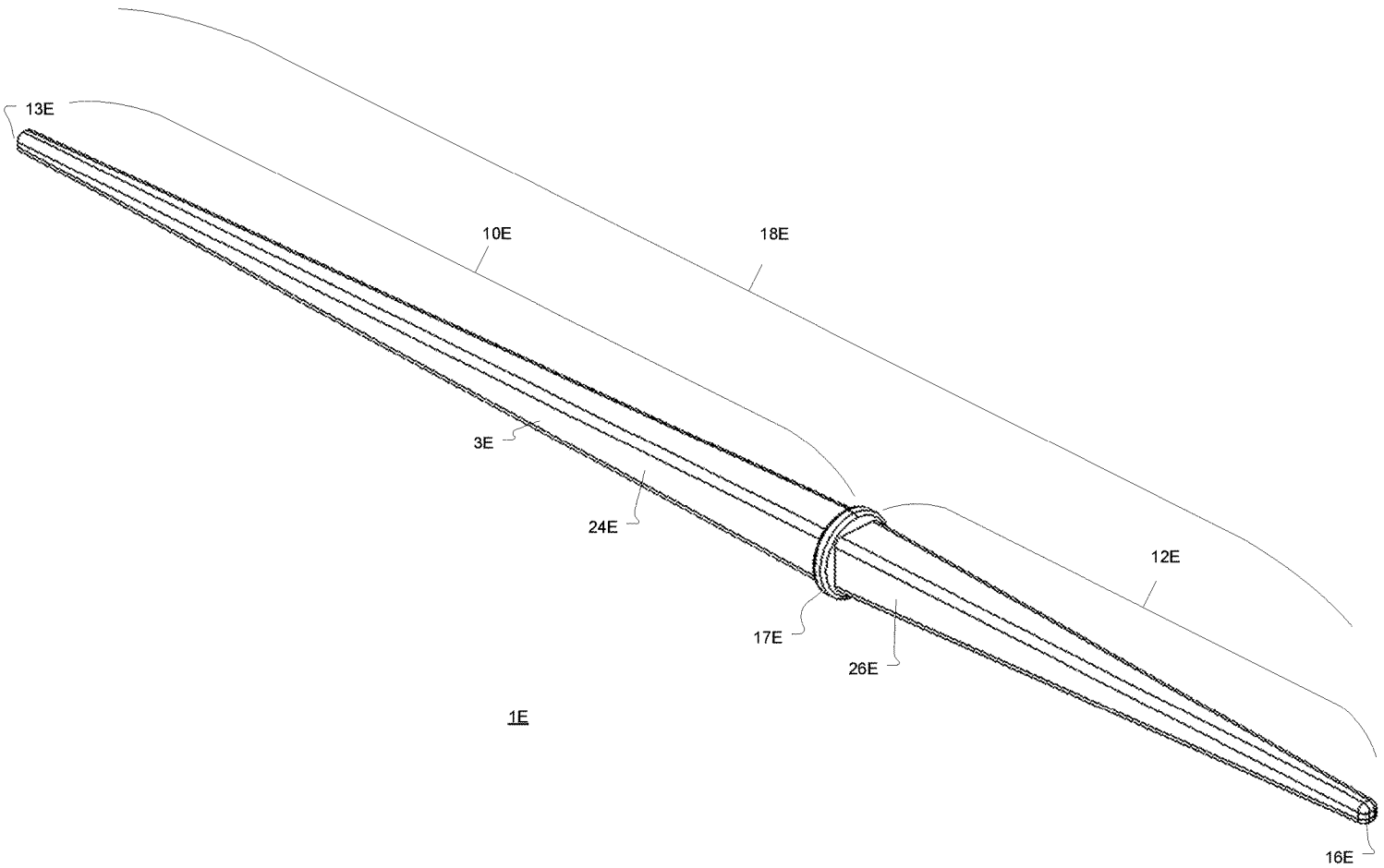
FIG. 9A is a simplified isometric diagram of a sixth embodiment of a chopstick according to various embodiments.
Figure 9B:
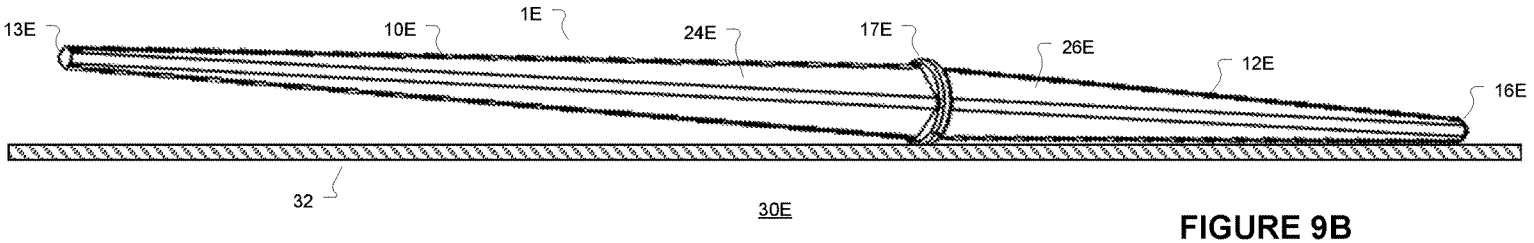
FIG. 9B is a left side, isometric diagram of the sixth embodiment of a chopstick resting on a horizontal surface according to various embodiments.
Figure 9C:
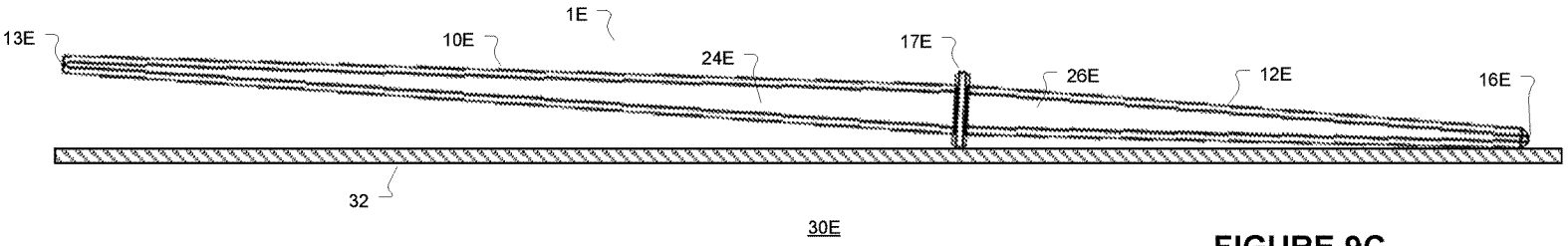
FIG. 9C is a left side diagram of the sixth embodiment of a chopstick resting on a horizontal surface according to various embodiments.

FIG. 9A is a simplified isometric diagram of a sixth embodiment of a chopstick 1E according to various embodiments. FIG. 9B is a left side, isometric diagram of a system 30E including the sixth embodiment of a chopstick 1E resting on a horizontal surface 32 according to various embodiments. FIG. 9C is a left side diagram of a system 30E including the sixth embodiment of a chopstick resting on a horizontal surface 32 according to various embodiments. As shown in FIGS. 9A-C, the chopstick 1E may include a single component 3E in an embodiment.

In an embodiment, the single component 3E may extend along an elongated or longitudinal axis 18E of the chopstick 1E. The chopstick's 1E elongated or longitudinal axis 18E may include an eating section 10E, a pivot point 17E, and a handling section 12E in an embodiment where the pivot point 17E is located between the eating section 10E and the handling section 12E. Further in an embodiment, the mass of the handling section 12E right of the pivot point 17E may be greater than the mass of the eating section 10E left of the pivot point 17E at all times (mass is fixed in both sections 10E, 12E of the component 3E). The eating section 10E may become instantly (subject to force of gravity acting on chopstick 1E) and remain elevated on a horizontal surface 32 when placed or rested on the horizontal surface 32 as shown in FIGS. 9B and 9C.

The handling section 12D may include a proximal section adjacent the pivot point 17E and a distal end 16E. Similarly, the eating section 10E may include a proximal end adjacent the pivot point 17E and a distal end 13E where the distal end 13E may be more likely employed by User to grip food or other elements. As shown in FIGS. 9A-C, the handling section 12E may be tapered from its proximal section to its distal end 16E and form a plurality of sides 26E, including four sides 26E in an embodiment.

As also shown in FIGS. 9A-C, the pivot point 17E may have a greater effective diameter than the effective diameters of the eating section 10E and handling section 12E. The pivot point 17E may have various cross sectional shapes relative to the longitudinal axis 18E including round, elliptical, square, rectangular, or other polygon.

Similarly, the eating section 10E may be tapered from its proximal end adjacent the pivot point 17E to its distal end 13E and form a plurality of sides 24E, including four sides 24E in an embodiment. The handling section's 12E effective cross sectional diameter may be the same is similar to the eating section's 10E effective cross sectional diameter. As noted, the eating section 10E, the pivot point 17E, and the handling section 12E may be sections of a single component 3E. The single component 3E may be comprised of one material or element in an embodiment. The single material may include natural and man-made elements including but not limited to metals, alloys, minerals, petroleum based materials (polymers and others), and plant based materials (wood and others). In an embodiment, the chopstick 1E components may be formed via an extrusion process where the single material is man-made.

In an embodiment, the handling section 12E and the eating section 10E may have various cross sectional shapes relative to the longitudinal axis 18E including round, elliptical, square, rectangular, or other polygon. In an embodiment, a region of the eating section 10E of the component 3E may be hollow. The handing section 12E may not be hollow or include a smaller hollow region. As noted, the eating section's 10E lower mass relative to the handling section's 12E mass, may enable at least a distal region 13E of the component's 3E eating section 10E to be elevated above a horizontal surface 32 when placed thereon.

Figure 10A:
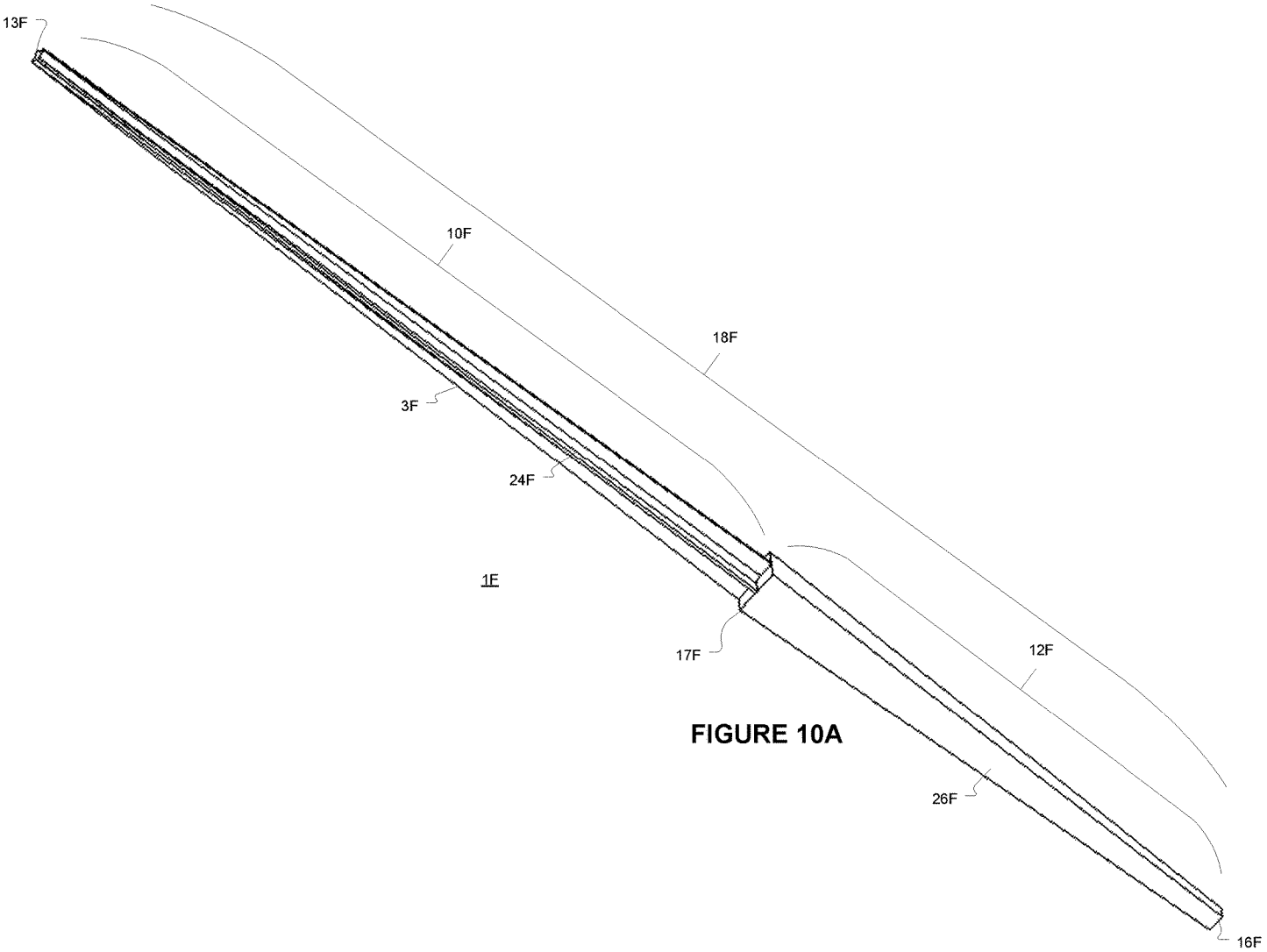
FIG. 10A is a simplified isometric diagram of a seventh embodiment of a chopstick according to various embodiments.
Figure 10B:
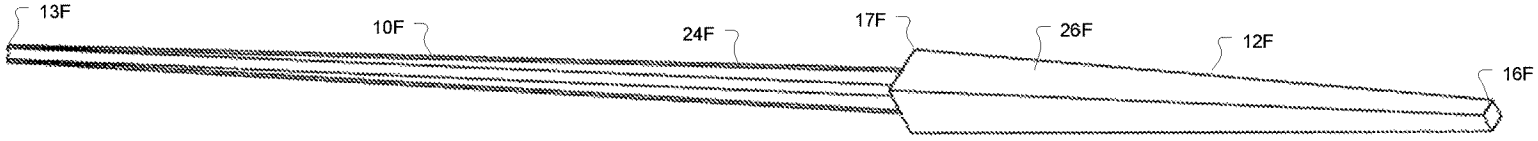
FIG. 10B is a left side, isometric diagram of the seventh embodiment of a chopstick according to various embodiments.
Figure 10C:
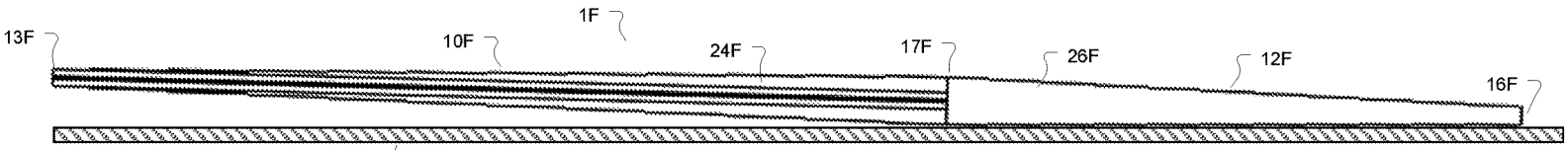
FIG. 10C is a left side diagram of the seventh embodiment of a chopstick resting on a horizontal surface according to various embodiments.

FIG. 10A is a simplified isometric diagram of a seventh embodiment of a chopstick 1F according to various embodiments. FIG. 10B is a left side, isometric diagram of the seventh embodiment of a chopstick 1F according to various embodiments. FIG. 10C is a left side diagram of a system 30F including the seventh embodiment of a chopstick 1F resting on a horizontal surface 32 according to various embodiments. As shown in FIGS. 10A-C, the chopstick 1F may include a single component 3F in an embodiment.

In an embodiment, the single component 3F may extend along an elongated or longitudinal axis 18F of the chopstick 1F. The chopstick's 1F elongated or longitudinal axis 18F may include an eating section 10F and a handling section 12F in an embodiment where the pivot point 17F is located between the eating section 10F and the handling section 12F. Further in an embodiment, the mass of the handling section 12F right of the pivot point 17F may be greater than the mass of the eating section 10F left of the pivot point 17F at all times (mass is fixed in both sections 10F, 12F of the component 3F). The eating section 10F may become instantly (subject to force of gravity acting on chopstick 1F) and remain elevated on a horizontal surface 32 when placed or rested on the horizontal surface 32 as shown in FIG. 10C.

The handling section 12E may include a proximal section at the pivot point 17F and a distal end 16F. Similarly, the eating section 10F may include a proximal end at the pivot point 17F and a distal end 13F where the distal end 13F may be more likely employed by User to grip food or other elements. As shown in FIGS. 10A-C, the handling section 12F may be tapered from its proximal section to its distal end 16F and form a plurality of sides 26F, including four sides 26F in an embodiment.

Similarly, the eating section 10F may be tapered from its proximal end at the pivot point 17F to its distal end 13F and form a plurality of fins 24F, including four fins 24F in an embodiment. The handling section's 12F effective cross sectional diameter may be the same is similar to the eating section's 10F effective cross sectional diameter. As noted, the eating section 10F and the handling section 12F may be sections of a single component 3F. The single component 3F may be comprised of one material or element in an embodiment. The single material may include natural and man-made elements including but not limited to metals, alloys, minerals, petroleum based materials (polymers and others), and plant based materials (wood and others). In an embodiment, the chopstick 1F components may be formed via an extrusion process where the single material is man-made.

In an embodiment, the handling section 12F and the eating section 10F may have various cross sectional shapes relative to the longitudinal axis 18F including round, elliptical, square, rectangular, or other polygon. As noted, the eating section 10F may have a plurality of fins 24F having a lower mass than sides 26F of the handling section 12F. The eating section's 10E lower mass relative to the handling section's 12F mass due to the fins 24F may enable at least a distal region 13F of the component's 3F eating section 10F to be elevated above a horizontal surface 32 when placed thereon.

Figure 11A:
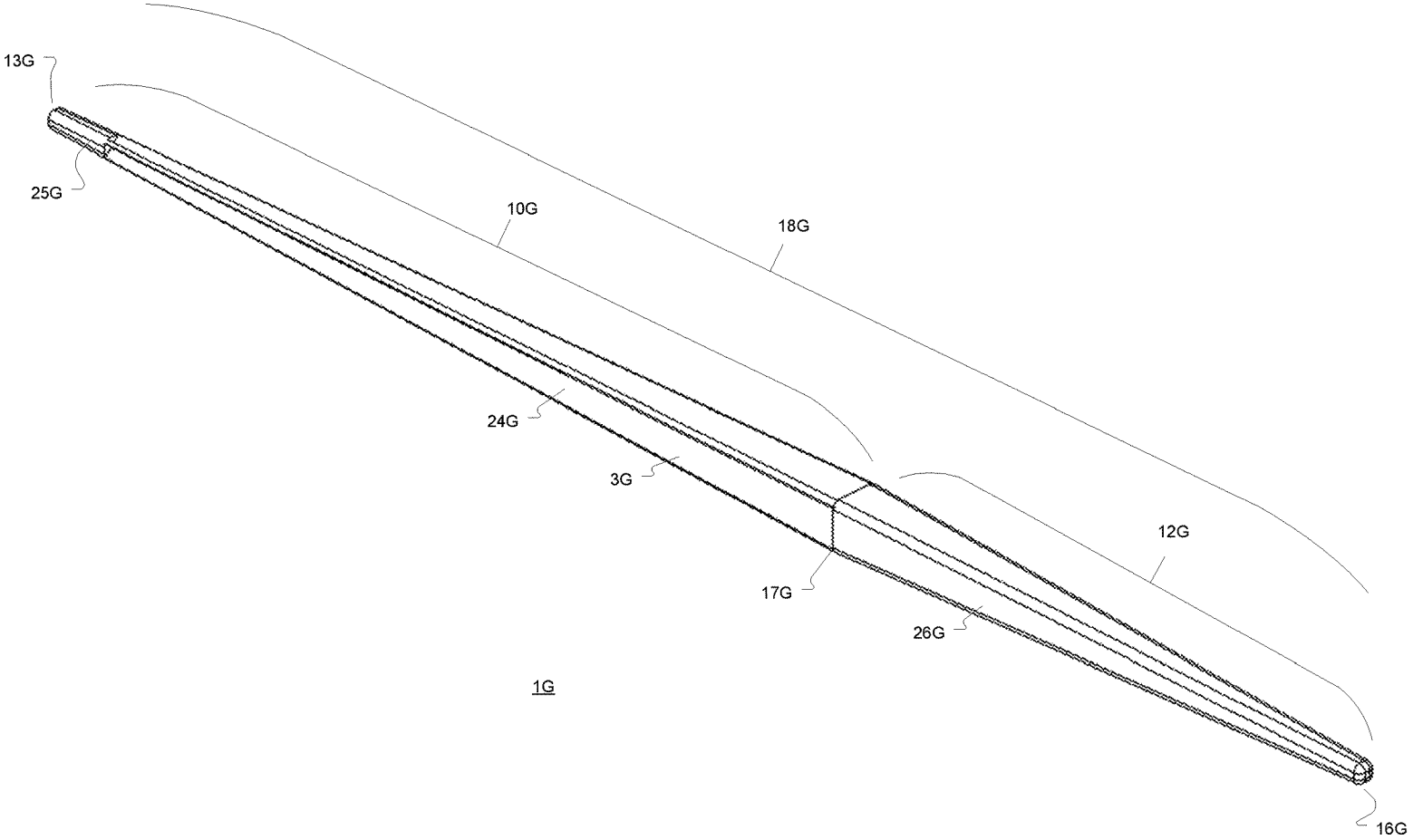
FIG. 11A is a simplified isometric diagram of a eighth embodiment of a chopstick according to various embodiments.
Figure 11B:
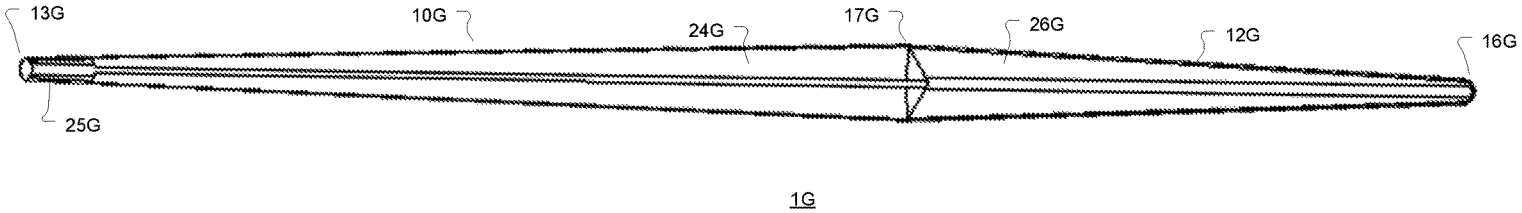
FIG. 11B is a left side, isometric diagram of the eighth embodiment of a chopstick according to various embodiments.
Figure 11C:
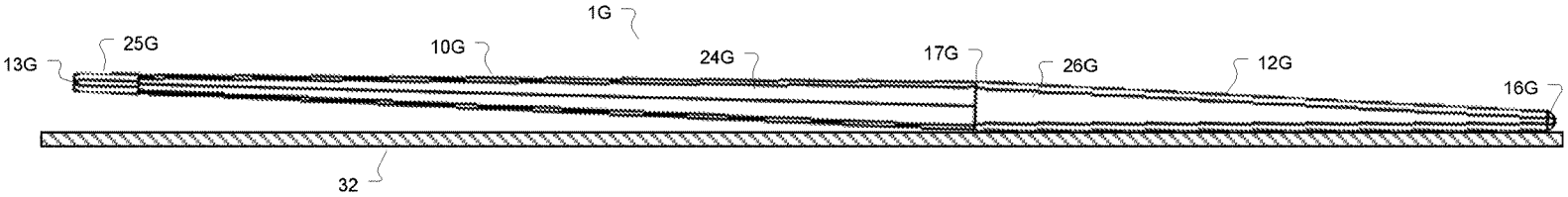
FIG. 11C is a left side diagram of the eighth embodiment of a chopstick resting on a horizontal surface according to various embodiments.

FIG. 11A is a simplified isometric diagram of a eighth embodiment of a chopstick 1G according to various embodiments. FIG. 11B is a left side, isometric diagram of the eighth embodiment of a chopstick 1G according to various embodiments. FIG. 11C is a left side diagram of a system 30G including the eighth embodiment of a chopstick 1G resting on a horizontal surface according to various embodiments. As shown in FIGS. 11A-C, the chopstick 1G may include a single component 3F in an embodiment.

In an embodiment, the single component 3G may extend along an elongated or longitudinal axis 18G of the chopstick 1G. The chopstick's 1G elongated or longitudinal axis 18G may include an eating section 10G and a handling section 12G in an embodiment where the pivot point 17G is located between the eating section 10G and the handling section 12F. Further in an embodiment, the mass of the handling section 12G right of the pivot point 17G may be greater than the mass of the eating section 10G left of the pivot point 17G at all times (mass is fixed in both sections 10G, 12G of the component 3G). The eating section 10G may become instantly (subject to force of gravity acting on chopstick 1G) and remain elevated on a horizontal surface 32 when placed or rested on the horizontal surface 32 as shown in FIG. 11C.

The handling section 12F may include a proximal section at the pivot point 17G and a distal end 16G. Similarly, the eating section 10G may include a proximal end at the pivot point 17G and a distal end 13G. As shown in FIGS. 11A-11C, the eating section 10G distal end 13G may include a different enclosed region 25G along the longitudinal axis 18G than the remainder of the eating section 10G. As noted below, the eating section 10G may include a plurality of fins 24G extending from its proximal end to its distal end 13G enclosed region 25G. The distal enclosed region 25G may include enclose the fins 24G to form side walls or other shapes to make it easier for a User to grip food or other elements versus fins 24G extending to the distal end 13G as in chopstick 1F. As shown in FIGS. 11A-C, the handling section 12G may be tapered from its proximal section to its distal end 16G and form a plurality of sides 26G, including four sides 26G in an embodiment.

Similarly, the eating section 10G may be tapered from its proximal end at the pivot point 17G to its distal end 13F and form a plurality of fins 24G, including four fins 24G in an embodiment up to its distal end 13G enclosed region 25G. The handling section's 12G effective cross sectional diameter may be the same is similar to the eating section's 10G effective cross sectional diameter. As noted, the eating section 10G and the handling section 12G may be sections of a single component 3G. The single component 3G may be comprised of one material or element in an embodiment. The single material may include natural and man-made elements including but not limited to metals, alloys, minerals, petroleum based materials (polymers and others), and plant based materials (wood and others). In an embodiment, the chopstick 1G components may be formed via an extrusion process where the single material is man-made.

In an embodiment, the handling section 12G and the eating section 10G may have various cross sectional shapes relative to the longitudinal axis 18G including round, elliptical, square, rectangular, or other polygon. As noted, the eating section 10G may have a plurality of fins 24G having a lower mass than sides 26G of the handling section 12G. The eating section's 10G lower mass relative to the handling section's 12G mass due to the fins 24G may enable at least the distal enclosed region 25G of the component's 3G eating section 10G to be elevated above a horizontal surface 32 when placed thereon.

Figure 12A:
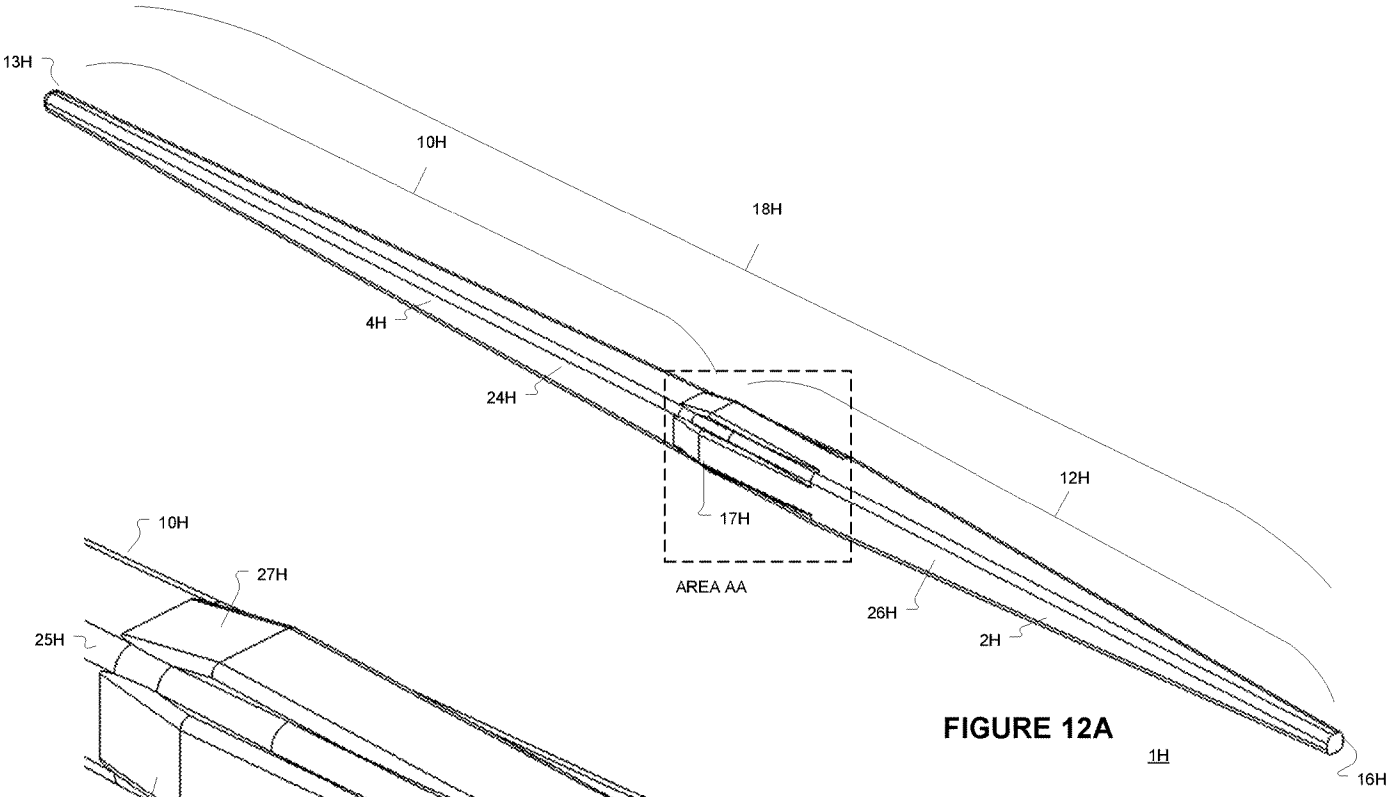
FIG. 12A is a simplified isometric diagram of a ninth embodiment of a chopstick according to various embodiments.
Figure 12D:
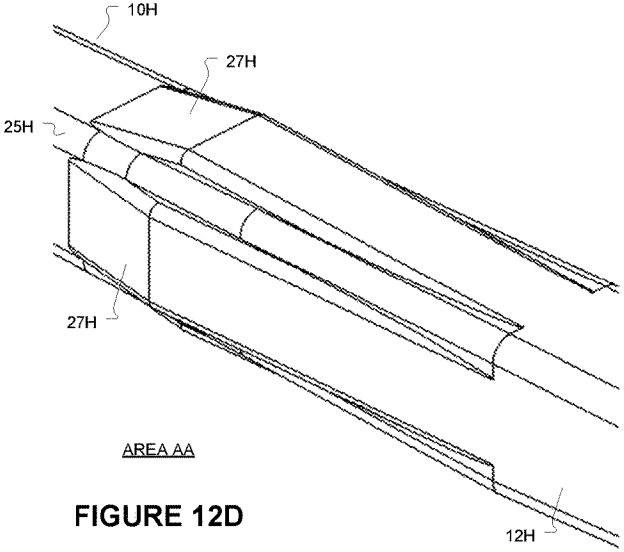
FIG. 12D is a simplified isometric diagram of area AA of the ninth embodiment of a chopstick according to various embodiments.
Figure 12B:
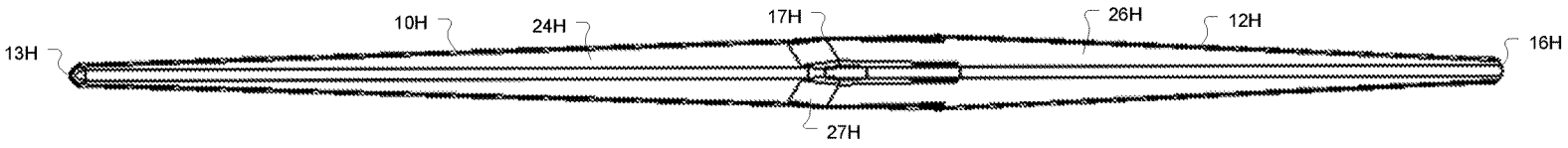
FIG. 12B is a left side, isometric diagram of the ninth embodiment of a chopstick according to various embodiments.
Figure 12C:
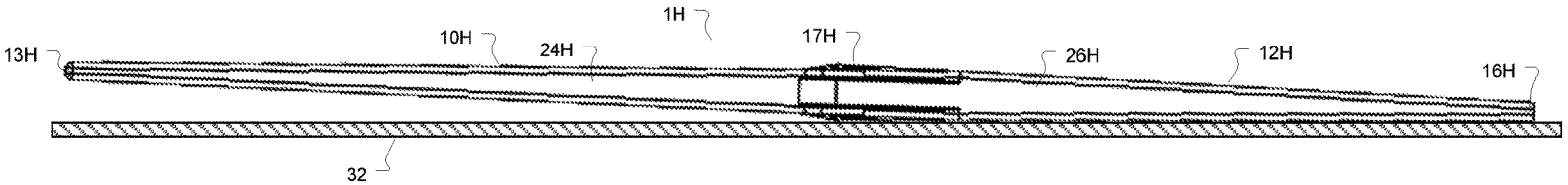
FIG. 12C is a left side diagram of the ninth embodiment of a chopstick resting on a horizontal surface according to various embodiments.

FIG. 12A is a simplified isometric diagram of a ninth embodiment of a chopstick 1H according to various embodiments. FIG. 12B is a left side, isometric diagram of the ninth embodiment of a chopstick 1H according to various embodiments. FIG. 12C is a left side diagram of a system 30H including the ninth embodiment of a chopstick 1H resting on a horizontal surface 32 according to various embodiments. FIG. 12D is a simplified isometric diagram of area AA of the ninth embodiment of a chopstick 1H according to various embodiments. As shown in FIGS. 12A-D, the chopstick 1H may include a first component 2H and a second component 4H that may be coupled together via elements 27H and 25H of the first component 2H and a second component 4H, respectively.

In an embodiment, the first component 2 and second component 4 when coupled as shown FIGS. 12A-D, may extend along an elongated or longitudinal axis 18H of the chopstick. The chopstick's 1H elongated or longitudinal axis 18H may include an eating section 10H and a handling section 12H in an embodiment with a pivot point 17H formed there between due to the shape of elements 27H and 25H of the first component 2H and a second component 4H. Further in an embodiment, the mass of the handling section 12H right of the pivot point 17H may be greater than the mass of the eating section 10H left of the pivot point 17H at all times (mass is fixed in both sections 10H, 12H). In such an embodiment, at least a region of the distal end 13H of the eating section 10H may remain and become instantly (subject to force of gravity acting on chopstick 1H) elevated about a horizontal resting surface 32 when placed on the horizontal surface 32 as shown in FIG. 12C.

As shown in FIGS. 12A-D, the chopstick's 1H first component 2H may include the handling section 12H of the longitudinal axis 18H and the second component 4 may include the eating section 10H of the longitudinal axis 18H. The first component's 2H handling section 12H may include a proximal end near the pivot point 17H and a distal end 16H. Similarly, the second component's 4H eating section 10H may include a proximal end near the pivot point 17H and a distal end 13H where the distal end 13H may be more likely employed by User to grip food or other elements. As shown in FIGS. 12A-D, the first component's 2H handling section 12H may be tapered from its proximal end near the pivot point 17H to its distal end 16H and form a plurality of surfaces 26H, including four surfaces 26H in an embodiment.

Similarly, the second component's 4H eating section 10H may be tapered from its proximal end near the pivot point 17H to its distal end 13H and form a plurality of surfaces 26H, including four surfaces 26H in an embodiment. In an embodiment the elongated tapered sides 26H of the first component's 2H handling section 12H may be mirror images of each other and all elongated tapered sides 24H of the second component's 4H eating section 10H may be mirror images of each other. In addition, the first component's 2H handling section 12H or of the second component's 4H eating section 10H may include undulations or inward indentations.

In an embodiment, the second component's 4H eating section 10H may be formed substantially of first material and the first component's 2H handling section 12H may be formed substantially of a second, different material. The second material may have a greater density than the first material. In another embodiment, the second component's 4H eating section 10H and the first component's 2H handling section 12H may be formed substantially of same material or element. In an embodiment, the first and second materials may include natural and man-made elements including but not limited to metals, alloys, minerals, petroleum based materials (polymers and others), and plant based materials (wood and others).

In an embodiment, the first component's 2H handling section 12H and the second component's 4H eating section 10H may have various cross sectional shapes relative to the longitudinal axis 18H including round, elliptical, square, rectangular, or other polygon. In an embodiment, the first component's 2H handling section 12H may be securely and removably coupled to the second component's 4H eating section 10H via the elements 27H and 25H of the first component 2H and a second component 4H, respectively. In an embodiment the first component's 2H elements 27H may be sized and shaped to securely (and releaseably in an embodiment) snap over or engage a section of the second component's 4H distal end including the elements 25H. The first component 2H may include a plurality of the elements 27H including one on each side 26H in an embodiment and further including four elements 27H in an embodiment.

Such a configuration may enable the first component's 2H handling section 12H to be securely and removably coupled to the second component's 4H eating section 10H. In such an embodiment, a User may be able to remove the second component's 4H eating section 10H from the chopstick 1H and replace it with another the second component's 4H eating section 10H while reusing the first component's 2H handling section 12H.

The accompanying drawings that form a part hereof show, by way of illustration and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment.

What is claimed is:

1. A chopstick having a length along a longitudinal axis comprising:

a monolithic component having a length along a longitudinal axis including a handling section adjacent an eating section between a proximal end and distal end, the component length about the chopstick length, the handling section extending along a first part of the component longitudinal axis for a first length and including a proximal end and a distal end, its proximal end at the component proximal end;

the adjacent eating section extending along a second, different part of the longitudinal axis for a second length, including a proximal end and a distal end, its proximal end adjacent the handling section distal end, its distal end at the component distal end, the second length greater than the first length, and the sum of the first length and the second length equal to the component length; and a pivot point located between the handling section distal end and the eating section proximal end;

wherein the handling section has a greater fixed mass than the eating section so when the chopstick is placed on a horizontal surface, at least the eating section distal end is elevated above the horizontal surface.

2. The chopstick as recited in claim 1, wherein the handling section has a greater fixed mass than the eating section so when the chopstick is placed on a horizontal surface, a majority of the eating section is elevated above the horizontal surface about the pivot point.

3. The chopstick as recited in claim 1, wherein the eating section is tapered from about its proximal end to about its distal end.

4. The chopstick as recited in claim 3, wherein the handling section is tapered from about its distal end to about its proximal end.

5. The chopstick as claimed in claim 1, wherein the component is formed from wood.

6. The chopstick as claimed in claim 1, wherein the component is formed from man-made materials.

7. The chopstick as claimed in claim 1, wherein the component is formed from natural materials.

8. The chopstick as claimed in claim 1, wherein the component is formed via an extrusion process.

9. The chopstick as claimed in claim 1, wherein the eating section includes a hollow area.

10. The chopstick as claimed in claim 9, wherein the handling section includes a hollow area smaller in volume than the eating section hollow area.

11. The chopstick as claimed in claim 1, wherein the handling section and the eating section are substantially rectangular in cross section.

12. The chopstick as claimed in claim 1, wherein the handling section's largest effective outer diameter is greater than the eating section's largest effective outer diameter.

13. The chopstick as recited in claim 1, wherein the handling section is tapered from about its distal end to about its proximal end and forms a plurality of sides.

14. The chopstick as recited in claim 13, wherein the eating section is tapered from about its proximal end to about its distal end and forms a plurality of sides.

15. The chopstick as claimed in claim 14, wherein the handling section has a greater effective outer diameter than the eating section's effective outer diameter.

16. The chopstick as recited in claim 13, wherein the eating section is tapered from about its proximal end to about its distal end and forms a plurality of tapered fins extending from about the eating section's proximal end to about the eating section's distal end.

17. The chopstick as recited in claim 1, wherein the eating section is tapered from about its proximal end to about its distal end, and the handling section is tapered from about the pivot point to about the handling section proximal end.

18. The chopstick as recited in claim 1, wherein the eating section is tapered from about its proximal end to about its distal end and forms a plurality of tapered fins extending from about the eating section's proximal end to about and before the eating section's distal end.

* * * * *